US005843278A

United States Patent [19]

Goyal et al.

[11] Patent Number: 5,843,278

[45] Date of Patent: Dec. 1, 1998

[54] METHOD OF PRODUCING SOFT PAPER PRODUCTS

[75] Inventors: Gopal C. Goyal, Cloquet; Robert E. Packwood, Jr., Duluth, both of Minn.; Mary L. Minton, Clarkston, Wash.

[73] Assignee: Potlatch Corporation, Spokane, Wash.

[21] Appl. No.: 799,234

[22] Filed: Feb. 14, 1997

[51] Int. Cl.[6] ..... D21C 9/00

[52] U.S. Cl. ..... 162/9; 162/90; 162/100; 162/146; 162/157.6; 162/182

[58] Field of Search ..... 162/9, 146, 100, 162/157.6, 63, 70, 182, 90; 8/116.1, 125

[56] References Cited

U.S. PATENT DOCUMENTS

| | | | |
|---|---|---|---|
| 803,391 | 10/1905 | Blackmore et al. . | |
| 1,016,178 | 10/1912 | Sammet et al. . | |
| 3,707,436 | 12/1972 | O'Connor | 162/9 |
| 4,118,271 | 10/1978 | Oku et al. | 162/31 |
| 4,227,964 | 10/1980 | Kerr et al. | 162/9 |
| 4,431,480 | 2/1984 | Markham et al. | 162/19 |
| 4,431,481 | 2/1984 | Drach et al. | 162/100 |
| 4,734,162 | 3/1988 | Ampulski | 162/84 |
| 4,869,782 | 9/1989 | Nelson et al. | 162/9 |
| 4,976,819 | 12/1990 | Minton | 162/9 |
| 5,041,192 | 8/1991 | Sunol et al. | 162/63 |
| 5,525,122 | 6/1996 | Liebergott et al. | 8/116.1 |

*Primary Examiner*—Peter Chin

*Attorney, Agent, or Firm*—Wells, St. John, Roberts, Gregory & Matkin P.S.

[57] ABSTRACT

A method of producing a soft paper product incudes, a) providing a pulp sheet at a moisture content of no greater than about 10%, the pulp of said sheet not having been previously subjected to dry milling and not being predominately anfractuous; b) treating the pulp sheet at moisture content of no greater than about 10% with liquid ammonia of a concentration of at least 90% for a period of time less than or equal to about 60 seconds effective to increase degree of softness in the sheet of pulp from that existing prior to the treating, the pulp in the treated sheet remaining not predominately anfractuous after said treating; c) forming the treated pulp sheet into a papermaking slurry; and d) feeding the papermaking slurry into the headbox of a paper machine and producing a tissue paper product therefrom which has greater softness than a tissue paper product made from the same pulp which has not been so treated with said ammonia.

37 Claims, 1 Drawing Sheet

METHOD OF PRODUCING SOFT PAPER PRODUCTS

TECHNICAL FIELD

This invention relates generally to methods of producing soft paper products, such as tissue paper products.

BACKGROUND OF THE INVENTION

This invention arose from a need to be able to produce soft tissue products from conventional paper grade pulps made from various lignocellulosic materials which are not ideally suited for producing soft paper products. Examples include pulp produced from western softwoods which typically produce a rather harsh product. Different pulp species are frequently blended with softwood pulps to improve softness. However for certain paper mills, a wide variety of species for blending is not readily available.

Conventional paper grade pulps typically have high tensile strength and high Gurley stiffness and correspondingly not the degree of softness desired for tissue manufacture. In order to achieve desired softness, tensile index and Gurley stiffness need to be decreased. Small improvements can be made to tissue softness by methods such as chemical additions, optimizing creping and other papermaking operations including paper sheet post-treatment such as embossing. Still, such methods may not always produce the required or desired softness.

The prior art has recognized that certain mechanical treatments of certain pulps prior to formation into a sheet of paper can enhance softness. One example is our U.S. Pat. No. 4,976,819, which is hereby incorporated by reference. Further, U.S. Pat. No. 4,869,782 to Nelson et. al. apparently discloses a process to produce softness, whereby a pulp is initially dry milled to render its fibers substantially or predominately anfractuous (i.e., curled, kinked, twisted, bent or otherwise contorted). After being rendered anfractuous by such specific mechanical treatment, the treated pulp is subjected to liquid ammonia exposure to set or permanently retain the anfractuous nature of the fibers. This apparently enables such fibers to retain these desired anfractuous properties when exposed to water for an extended period of time, such as when reconstituted with water in preparation for feeding into the headbox of a paper machine.

It would be desirable to develop methods which facilitate use of conventional paper grade pulps in producing soft paper products, such as tissue.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
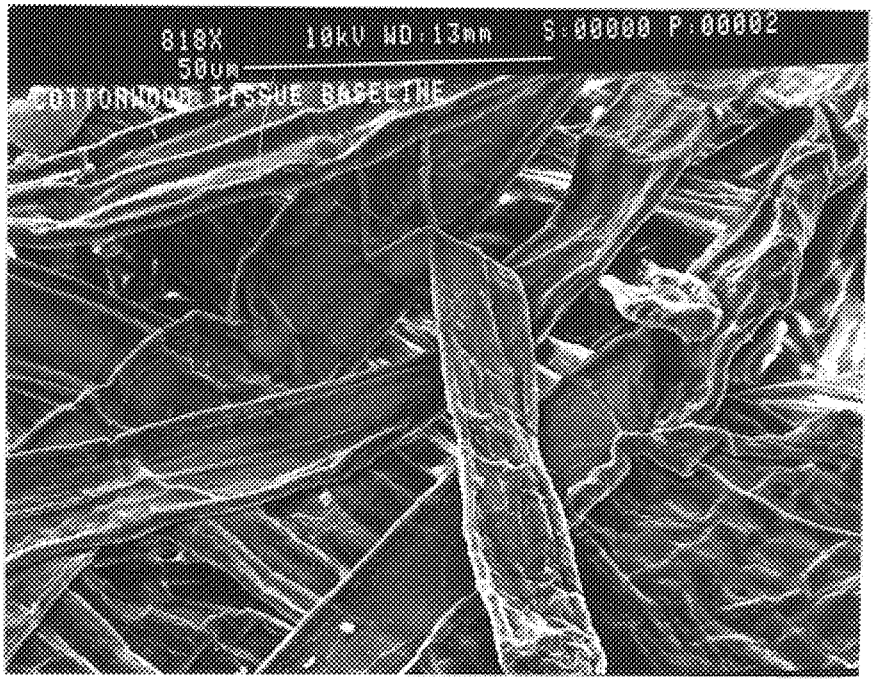
FIGS. 1 and 2 display scanning electron micrographs of hand sheets formed from pulp treated in accordance with the invention (FIG. 2) and from pulp not treated in accordance with the invention (FIG. 1).

This disclosure of the invention is submitted in furtherance of the constitutional purposes of the U.S. Patent Laws "to promote the progress of science and useful arts" (Article 1, Section 8).

In accordance with one aspect of the invention, a method of producing a soft paper product comprises:

providing a cellulosic pulp having a moisture content of no greater than about 15%, the pulp not being predominately anfractuous;

treating the pulp at moisture content of no greater than about 15% with liquid ammonia of a concentration of at least 50% for a period of time effective to increase degree of softness in the pulp from that existing prior to the treating, the pulp remaining not predominately anfractuous after said treating;

forming the treated pulp into a papermaking slurry; and feeding the papermaking slurry into the headbox of a paper machine and producing a paper product therefrom which has greater softness than a paper product made from the same pulp which has not been so treated with said ammonia.

In accordance with a preferred embodiment, the method of producing soft paper product begins with formation of a cellulosic pulp slurry, preferably having an alpha content of no greater than 95%. An example pulp slurry of conventional paper grade pulp includes chemical or mechanical pulp having water content typically of from 25% to 80% by volume. Such pulp from which a pulp slurry is formed is not predominately anfractuous, and has not been previously subjected to dry milling. Preferably and typically, substantially all of the fibers of said pulp (i.e., greater than 95%) are not anfractuous. Such cellulosic pulp slurry is conventionally formed into a pulp sheet having a moisture content of no greater than about 15% by weight. Accordingly, the predominate fibers of said pulp sheet are not anfractuous.

The pulp sheet at a moisture content of no greater than about 15% is subsequently treated with liquid ammonia of a concentration of at least 50% for a period of time effective to increase degree of softness in the sheet of pulp from that existing prior to the treating. The pulp in the treated sheet remains not predominately anfractuous after such treating. Preferably, the sheet being treated has a moisture content of less than or equal to about 10%, and more preferably less than or equal to about 8%. The liquid ammonia is preferably provided at a concentration of at least about 75%, and more preferably at least about 90%. Most preferably, the treating liquid ammonia is anhydrous. The effective treatment times with liquid ammonia at substantially atmospheric pressure and at a temperature of from −30° C. to about −40° C. are less than or equal to about 60 seconds, with from about 5 seconds to about 30 seconds being more preferred. The greater the concentration of ammonia, the less the understood required time for the effective treatment.

Pulp treated in accordance with preferred aspects of the invention has lower tensile strength, lower Gurley stiffness and a higher degree of softness from pulp that has not been so treated. The invention permits the use of conventional paper grade pulps of various lignocellulosic material to be used in tissue and other paper products where softness is desired. Blending of such treated pulp with other pulps can also, of course, be utilized although it is not particularly desirable in accordance with the preferred aspects of the invention which is only limited by the accompanying claims appropriately interpreted in accordance with the doctrine of equivalence.

Liquid ammonia treatment in the prior art has been understood to be conducted on cellulosic pulp fibers in the context of producing densified parchment type papers and densified kraft papers. Liquid ammonia has also been understood to be utilized in the prior art to sanforize cotton textile fiber to make it wrinkle resistant. However, with respect to such treatments of cellulosic fibers, such has been understood to result in an increase of both Gurley stiffness and tensile strength.

The effect of ammonia treatment on various physical properties of cottonwood pulp sheets having an alpha content of 88.44% treated in accordance with the invention are shown below in Table 1. All ammonia treatments were for approximately 5 seconds. The cottonwood pulp sheets being treated had a moisture content of approximately 6% immediately prior to treatment.

COTTONWOOD LIQUID AMMONIA TREATMENT

| SAMPLE | Tensile Index (N m/g) | Uncmprssd Bulk (cc/g) | Stretch (%) | Gurley Stiffness | Specific Modulus (Km) |
|---|---|---|---|---|---|
| Untreated | 12.1 | 7.1 | 1.5 | 13.6 | 69 |
| 100% ammonia | 0.8 | 7.6 | 8.4 | 3.2 | 25 |
| 90% ammonia | 1.5 | 6.8 | 1.5 | 5.4 | 27 |
| 75% ammonia | 1.9 | 6.5 | 1.8 | 5.9 | 48 |
| 50% ammonia | 7.0 | 5.2 | 1.4 | 11.3 | 113 |

Improvement in softness was somewhat apparent with the 50% treatment, and noticeably apparent in increasing degree as the ammonia concentration increased above 75%. The above reduction-to-practice ammonia treatments of such pulp also did not result in any dissolution of hemicelluloses from the pulp, resulting in essentially no yield loss upon treatment. Maximum increase in softness was found with the anhydrous treatment, and the Table 1 results also clearly show maximum effect on tensile index and Gurley stiffness being obtained with anhydrous ammonia treatment.

Figure 2:
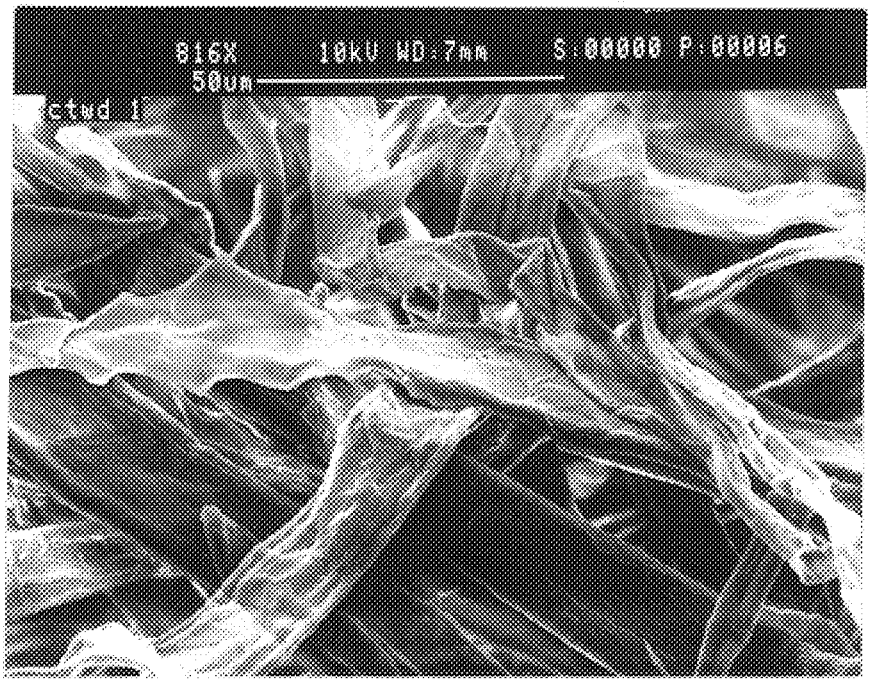

FIGS. 1 and 2 are SEM photomicrographs of treated and untreated pulp samples, respectively, and do not show any significant change in fiber morphology.

The treated pulp sheets are subsequently formed into a papermaking slurry, such as being reconstituted with water in a hydropulper. The papermaking slurry is then fed into the headbox of a papermachine. The paper product produced therefrom has greater softness than a paper product made from the same pulp which has not been so treated with liquid ammonia.

The above-described preferred embodiments were with respect to formation of pulp sheets and treatment of such sheets with liquid ammonia. Alternately, pulp of such above-described moisture content could be treated in a bulk or other non-sheet form with liquid ammonia without departing from the broader principles and scope of the invention. Further, in some instances the pulp producer and papermaker constitute the same entity located in the same general area. In yet other instances, some papermakers purchase pulp from suppliers which are located remote from the papermaking location. In such instances, the pulp will preferably be treated in accordance with the invention by the papermaker.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A method of producing a soft paper product comprising:

forming a pulp slurry derived from lingnocellosic pulp, the pulp from which said pulp slurry is formed not being predominately anfractuous;

forming the cellulosic pulp slurry into a pulp sheet having a moisture content of no greater than about 15%;

treating the pulp sheet at moisture content of no greater than about 15% with liquid ammonia of a concentration of at least 50% for a period of time effective to increase degree of softness in the sheet of pulp from that existing prior to the treating, the pulp in the treated sheet remaining not predominately anfractuous after said treating;

forming the treated pulp sheet into a papermaking slurry; and feeding the papermaking slurry into the headbox of a paper machine and producing a paper product therefrom which has greater softness than a paper product made from the same pulp which has not been so treated with said ammonia.

2. The method of producing a paper product of claim 1 wherein the pulp from which said slurry is formed has not been previously subjected to dry milling.

3. The method of producing a paper product of claim 1 wherein the treating comprises treating the pulp sheet with liquid ammonia of a concentration of at least about 75%.

4. The method of producing a paper product of claim 1 wherein the treating comprises treating the pulp sheet with liquid ammonia of a concentration of at least about 90%.

5. The method of producing a paper product of claim 1 wherein the treating comprises treating the pulp sheet with anhydrous liquid ammonia.

6. The method of producing a paper product of claim 1 wherein the moisture content of the pulp sheet being treated is less than or equal to about 10%.

7. The method of producing a paper product of claim 1 wherein the moisture content of the pulp sheet being treated is less than or equal to about 8%.

8. The method of producing a paper product of claim 1 wherein the period of time is less than or equal to about 60 seconds.

9. The method of producing a paper product of claim 1 wherein the period of time is less than or equal to about 30 seconds.

10. A method of producing a soft paper product comprising:

providing a pulp sheet derived from lignocellulosic pulp at a moisture content of no greater than about 15%, the pulp of said sheet not being predominately anfractuous;

treating the pulp sheet at moisture content of no greater than about 15% with liquid ammonia of a concentration of at least 50% for a period of time effective to increase degree of softness in the sheet of pulp from that existing prior to the treating, the pulp in the treated sheet remaining not predominately anfractuous after said treating;

forming the treated pulp sheet into a papermaking slurry; and feeding the papermaking slurry into the headbox of a paper machine and producing a paper product therefrom which has greater softness than a paper product made from the same pulp which has not been so treated with said ammonia.

11. The method of producing a paper product of claim 10 wherein the pulp sheet was formed from a cellulosic pulp slurry which had not been previously subjected to dry milling.

12. The method of producing a paper product of claim 10 wherein the treating comprises treating the pulp sheet with liquid ammonia of a concentration of at least about 75%.

13. The method of producing a paper product of claim 10 wherein the treating comprises treating the pulp sheet with liquid ammonia of a concentration of at least about 90%.

14. The method of producing a paper product of claim 10 wherein the treating comprises treating the pulp sheet with anhydrous liquid ammonia.

15. The method of producing a paper product of claim 10 wherein the moisture content of the pulp sheet being treated is less than or equal to about 10%.

16. The method of producing a paper product of claim 10 wherein the moisture content of the pulp sheet being treated is less than or equal to about 8%.

17. The method of producing a paper product of claim 10 wherein the period of time is less than or equal to about 60 seconds.

18. The method of producing a paper product of claim 10 wherein the period of time is less than or equal to about 30 seconds.

19. A method of producing a soft tissue paper product comprising:

forming a pulp slurry derived from lignocellulosic pulp, the pulp from which said pulp slurry is formed not having been previously subjected to dry milling and not being predominately anfractuous;

forming the cellulosic pulp slurry into a pulp sheet having a moisture content of no greater than about 10%;

treating the pulp sheet at moisture content of no greater than about 10% with liquid ammonia of a concentration of at least 90% for a period of time less than or equal to about 60 seconds effective to increase degree of softness in the sheet of pulp from that existing prior to the treating, the pulp in the treated sheet remaining not predominately anfractuous after said treating;

forming the treated pulp sheet into a papermaking slurry; and feeding the papermaking slurry into the headbox of a paper machine and producing a tissue paper product therefrom which has greater softness than a tissue paper product made from the same pulp which has not been so treated with said ammonia.

20. The method of producing a paper product of claim 19 wherein the treating comprises treating the pulp sheet with anhydrous liquid ammonia.

21. The method of producing a paper product of claim 19 wherein the moisture content of the pulp sheet being treated is less than or equal to about 8%.

22. The method of producing a paper product of claim 19 wherein the period of time is less than or equal to about 30 seconds.

23. The method of producing a paper product of claim 19 wherein the treating comprises treating the pulp sheet with anhydrous liquid ammonia, and wherein the period of time is less than or equal to about 30 seconds.

24. A method of producing a soft tissue paper product comprising:

providing a pulp sheet derived from lignocellulosic pulp at a moisture content of no greater than about 10%, the pulp of said sheet not having been previously subjected to dry milling and not being predominately anfractuous;

treating the pulp sheet at moisture content of no greater than about 10% with liquid ammonia of a concentration of at least 90% for a period of time less than or equal to about 60 seconds effective to increase degree of softness in the sheet of pulp from that existing prior to the treating, the pulp in the treated sheet remaining not predominately anfractuous after said treating;

forming the treated pulp sheet into a papermaking slurry; and feeding the papermaking slurry into the headbox of a paper machine and producing a tissue paper product therefrom which has greater softness than a tissue paper product made from the same pulp which has not been so treated with said ammonia.

25. The method of producing a paper product of claim 24 wherein the treating comprises treating the pulp sheet with anhydrous liquid ammonia.

26. The method of producing a paper product of claim 24 wherein the moisture content of the pulp sheet being treated is less than or equal to about 8%.

27. The method of producing a paper product of claim 24 wherein the period of time is less than or equal to about 30 seconds.

28. The method of producing a paper product of claim 24 wherein the treating comprises treating the pulp sheet with anhydrous liquid ammonia, and wherein the period of time is less than or equal to about 30 seconds.

29. A method of producing a soft paper product comprising:

providing a pulp derived from lignocellulosic pulp, and having a moisture content of no greater than about 15%, the pulp not being predominately anfractuous;

treating the pulp at moisture content of no greater than about 15% with liquid ammonia of a concentration of at least 50% for a period of time effective to increase degree of softness in the pulp from that existing prior to the treating, the pulp remaining not predominately anfractuous after said treating;

forming the treated pulp into a papermaking slurry; and feeding the papermaking slurry into the headbox of a paper machine and producing a paper product therefrom which has greater softness than a paper product made from the same pulp which has not been so treated with said ammonia.

30. The method of producing a paper product of claim 29 wherein the provided pulp to be treated has not been previously subjected to dry milling.

31. The method of producing a paper product of claim 29 wherein the treating comprises treating the pulp with liquid ammonia of a concentration of at least about 75%.

32. The method of producing a paper product of claim 29 wherein the treating comprises treating the pulp with liquid ammonia of a concentration of at least about 90%.

33. The method of producing a paper product of claim 29 wherein the treating comprises treating the pulp with anhydrous liquid ammonia.

34. The method of producing a paper product of claim 29 wherein the moisture content of the pulp being treated is less than or equal to about 10%.

35. The method of producing a paper product of claim 29 wherein the moisture content of the pulp being treated is less than or equal to about 8%.

36. The method of producing a paper product of claim 29 wherein the period of time is less than or equal to about 60 seconds.

37. The method of producing a paper product of claim 29 wherein the period of time is less than or equal to about 30 seconds.

* * * * *

UNITED STATES PATENT AND TRADEMARK OFFICE

CERTIFICATE OF CORRECTION

PATENT NO. : 5,843,278
DATED : December 1, 1998
INVENTOR(S) : Gopal C. Goyal et al.

It is certified that error appears in the above-identified patent and that said Letters Patent is hereby corrected as shown below:

Column 3, line 32, replace "treated" with --untreated--.
Column 3, line 33, replace "untreated" with --treated--.

Signed and Sealed this

Twenty-seventh Day of July, 1999

*Attest:*

Q. TODD DICKINSON

*Attesting Officer*

*Acting Commissioner of Patents and Trademarks*